US010805704B2

(12) United States Patent
Miwa

(10) Patent No.: US 10,805,704 B2
(45) Date of Patent: Oct. 13, 2020

(54) EARPHONE

(71) Applicant: JVC KENWOOD CORPORATION, Yokohama-shi, Kanagawa (JP)

(72) Inventor: Yasuhiro Miwa, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 147 days.

(21) Appl. No.: 16/108,175

(22) Filed: Aug. 22, 2018

(65) Prior Publication Data

US 2019/0075384 A1 Mar. 7, 2019

(30) Foreign Application Priority Data

Sep. 6, 2017 (JP) ..... 2017-170782

(51) Int. Cl.

| | |
|---|---|
| ***H04R 1/00*** | (2006.01) |
| ***H04R 1/10*** | (2006.01) |
| *H04R 1/28* | (2006.01) |

(52) U.S. Cl.

CPC ..... *H04R 1/1016* (2013.01); *H04R 1/1075* (2013.01); *H04R 1/105* (2013.01); *H04R 1/2896* (2013.01); *H04R 2460/11* (2013.01)

(58) Field of Classification Search

CPC ..... H04R 1/1075

See application file for complete search history.

(56) References Cited

U.S. PATENT DOCUMENTS 4,239,945 A * 12/1980 Atoji ..... H04R 1/2819 381/349

FOREIGN PATENT DOCUMENTS

| | | |
|---|---|---|
| JP | 2015-167329 A | 9/2015 |
| JP | 2016-201706 A | 12/2016 |

* cited by examiner

*Primary Examiner* — Matthew A Eason

(74) *Attorney, Agent, or Firm* — Nath, Goldberg & Meyer; Jerald L. Meyer

(57) ABSTRACT

An earphone includes a speaker unit, a housing that receives the speaker unit therein, and a baffle that is arranged within the housing and supports an opposite surface of the speaker unit, which is opposite to a sound emission surface of the speaker unit, to define a first space between the opposite surface and the baffle. The baffle includes a vent hole through which the first space communicates with a second space that is opposite to the first space with respect to the baffle. A fourth space through which the first space communicates with a third space on a side of the sound emission surface of the speaker unit is defined between a side surface of the speaker unit and an inner surface of the housing.

5 Claims, 6 Drawing Sheets

EARPHONE

CROSS REFERENCE TO RELATED APPLICATION

This application is hazed upon and claims the benefit of priority under 35 U.S.C. § 119 from Japanese Patent Application No. 2017-170782, filed on Sep. 6, 2017, the entire contents of which are incorporated herein by reference.

BACKGROUND

The present invention relates to an earphone.

As shown in Japanese Patent Application Laid-Open No. 2015-167329 (Patent Literature 1), headphones provided with an acoustic passage for improving tone quality has been known. Through the acoustic passage on a baffle on which a speaker unit is mounted, a space in front of the baffle acoustically communicates with a space behind the baffle. Application of this structure to an earphone having a housing smaller than that of headphones has been considered. For example, Japanese Patent Application Laid-Open No. 2016-201706 (Patent Literature 2) describes such an earphone.

The earphone described in Patent Literature 2 includes a divisional wall in a housing. The divisional wall engages with and supports a speaker unit to divide an inner space of the housing into a front inner space and the rear inner space. A part of the housing in an external shape protrudes in a diameter direction thereof. On a part of the divisional wall corresponding to the protruding part, a communicating passage through which the front inner space communicates with the rear inner space is provided.

The earphone is often worn with its housing fitted into a concha, such as a canal type earphone with its earpiece to be inserted into an external auditory canal as shown in Patent Literature 2, or an inner ear type earphone without an ear piece. It is thus difficult to enlarge the housing in the diameter direction thereof.

That is, when the communicating passage is provided on the divisional wall on which the speaker unit is mounted, as the earphone in Patent Literature 2, it is difficult to have the external shape of the housing protruding in the diameter direction. It is thus necessary for the earphone to employ a speaker unit in a smaller diameter not to increase the size of the housing, which is a disadvantage in obtaining good tone quality.

SUMMARY

According to a first aspect of the embodiments, there is provided an earphone including: a speaker unit; a housing that receives the speaker unit therein; and a baffle that is arranged within the housing and supports an opposite surface of the speaker unit, which is opposite to a sound emission surface of the speaker unit, to define a first space between the opposite surface and the baffle, wherein the baffle includes a vent hole through which the first space communicates with a second space that is opposite to the first space with respect to the baffle, and a fourth space through which the first space communicates with a third space on a side of the sound emission surface of the speaker unit is defined between a side surface of the speaker unit and an inner surface of the housing.

According to a second aspect of the embodiments, there is provided an earphone including: a speaker unit; a housing that receives the speaker unit therein; and a baffle that is arranged within the housing and includes a base portion having a diameter larger than that of the speaker unit, and a plurality of supporting arm portions protruding from the base portion toward inside in a diameter direction of the baffle and supporting the side surface of the speaker unit at positions set apart in a circumferential direction of the baffle, wherein a space on one side of the baffle in the housing communicates with a space on another side of the baffle in the housing through vent holes, each of the vent holes formed between the speaker unit and adjacent supporting arm portions of the plurality of supporting arm portions.

DETAILED DESCRIPTION

Earphones according to a first exemplary embodiment and a second exemplary embodiment of the present invention will be described below.

First Embodiment

Figure 1:
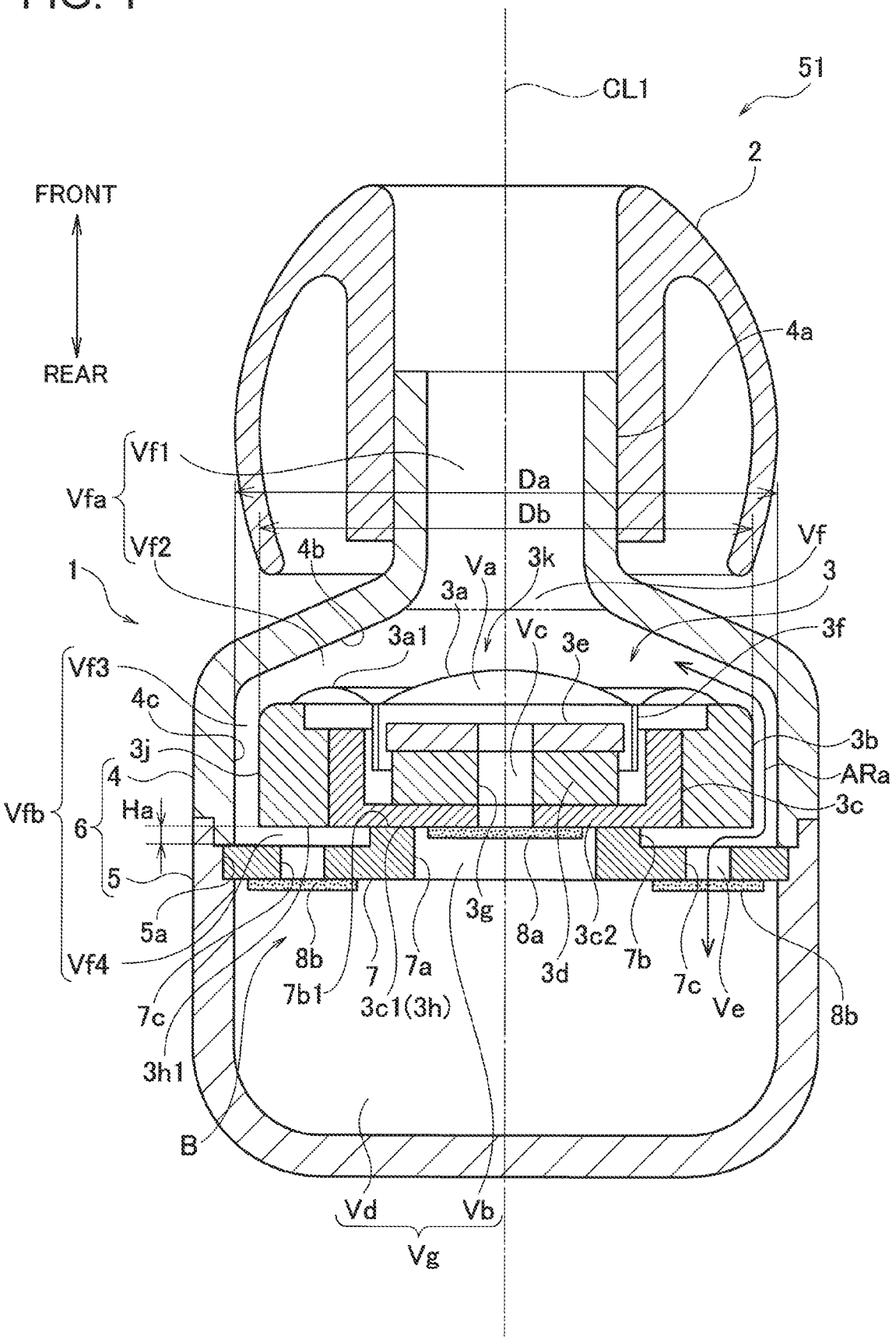
FIG. 1 is a vertical sectional view of an earphone according to a first exemplary embodiment of the present invention.

FIG. 1 is a vertical sectional view of an earphone 51. In the following, front-rear directions of the earphone 51 are defined by arrows shown in FIG. 1 for ease of explanation. The front is a side of the earphone 51 closer to an ear (head) to which the earphone 51 is mounted when used.

The earphone 51 includes a body portion 1, which receives the speaker unit 3 therein. The body portion 1 includes a sound tube portion 4*a* protruding in the front direction, on which an ear piece 2 is removably mounted. The earphone 51 is a typical canal type (earplug type) earphone used by inserting the ear piece 2 into an external auditory canal while mounting the body portion 1 on a concha. Each figure omits a code taken out from the speaker unit 3 to the outside, and a bushing.

The body portion 1 includes a front housing 4 and a rear housing 5 combined in the front-rear directions. The front housing 4 and the rear housing 5 in the combination make up a housing 6. The front housing 4 and the rear housing 5 in the housing 6 are formed around an axial line CL1 having an inner diameter Da in a bottomed shape. The above-described sound tube portion 4*a* in a tubular shape is formed at the front housing 4 to protrude along the axial line CL1 in the front direction.

The front housing 4 and the rear housing 5 are made of a resin. For example, the resin is a PC (polycarbonate). The ear piece 2 is made of a material having flexibility, such as a rubber. For example, the material is a silicone rubber.

Figure 2:
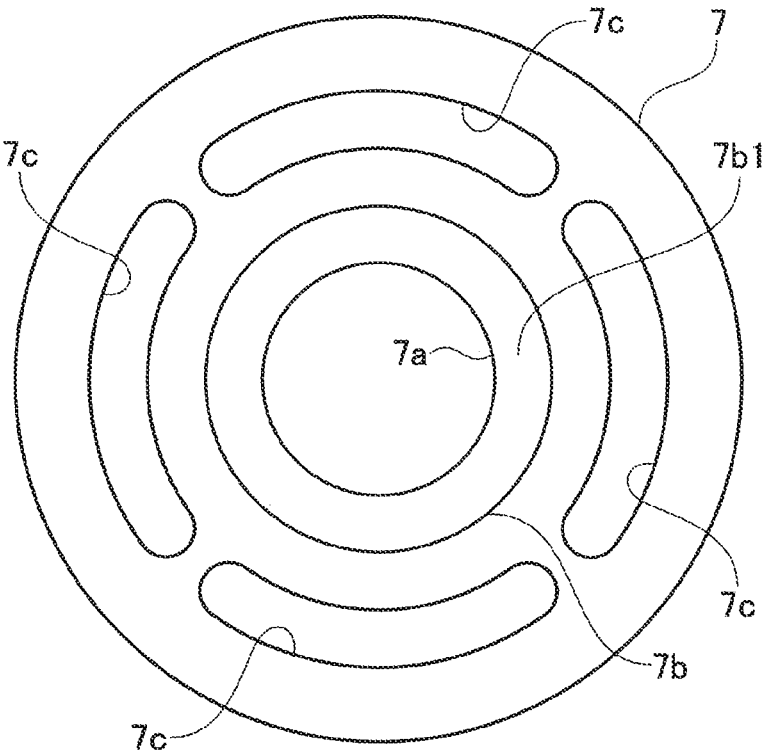
FIG. 2 is a plane view of a baffle of the earphone according to the first exemplary embodiment.

A baffle 7 is mounted within the housing 6. FIG. 2 is a plane view of the baffle 7. As shown in FIGS. 1 and 2, the baffle 7 presents an approximate disk shape and includes a penetration hole 7*a* in the center thereof. A peripheral portion of the penetration hole 7*a* includes a pedestal portion 7*b* in a circular shape, which protrudes toward one end of an axial direction thereof (in the front direction when used) with a height Ha (FIG. 1). A top surface 7*b*1 of the pedestal portion 7*b* is formed as a flat surface orthogonal to the axial line CL1.

A plurality of vent holes 7*c* is formed between an outer edge portion of the baffle 7 and the pedestal portion 7*b*, as penetration holes penetrating along the axial line CL1. In this example, the vent holes 7*c* are the penetration holes, each in a shape of an arc of a circle. The shape and the number of the vent holes 7 are not limited to this example. The shape may be a circular hole, or a square hole, for example. Hole different shapes may coexist.

The baffle 7 is made of a resin. For example, the resin is a PC (polycarbonate).

The speaker unit 3 is an electroacoustic converter to vibrate a diaphragm 3*a* back and forth on reception of an audio signal from the outside through the code (illustration omitted) and to output sounds mainly from a sound emission surface 3*k* to one side thereof (front side in FIG. 1). In detail, the speaker unit 3 includes a fixed portion having a frame 3*b*, yoke 3*c*, a magnet 3*d*, and a top plate 3*e*. The frame 3*b* is in a circular ring shape having an outer diameter Db and arranged on an outer edge portion of the speaker unit 3. The yoke 3*c* is in a pot shape having a bottom and fixed within the frame 3*b*. The magnet 3*d* is in a round column shape and fixed on a bottom wall portion 3*c*2 of the yoke 3*c*. The top plate 3*e* is in a disk shape and fixed on a front end of the magnet 3*d*. Moreover, the speaker unit 3 includes a movable portion having a voice coil bobbin 3*f* and the diaphragm 3*a*. The voice coil bobbin 3*f* is formed in a cylindrical shape and arranged around the axial line CL1 on the outside of the top plate 3*e* and the magnet 3*d*. The diaphragm 3*a* includes a diameter-direction middle portion with which a front end of the voice coil bobbin 3*f* communicates, and an outer edge portion fixed to the frame 3*b* as an edge 3*a*1. Moreover, the diaphragm 3*a* is movable back and forth along the axial line CL1.

The outer diameter Db of the speaker unit 3 is smaller than the inside diameter Da of the front housing 4. That is, the outer diameter Db<the inside diameter Da.

The top plate 3*e* and the magnet 3*d* include a penetration hole 3*g* extending in the front-rear directions in a center position thereof. A space Va just behind the diaphragm 3*a* communicates with a space Vb on a rear side of the speaker unit 3 through a space ye within the penetration hole 3*g*.

The above-described members are combined in the following steps, and the earphone 51 is manufactured accordingly.

First, a rear surface 3*h* of the speaker unit 3 is adhered and fixed on the pedestal portion 7*b* of the baffle 7 to have the axial line CL1 as the common central axis. In this example, the rear surface 3*h* is a rear surface 3*c*1 of the yoke 3*c*. The way of the fixation is not limited to the adhesion by a glue and may be sticking using a double-sided tape.

The baffle 7 on which the speaker unit 3 is mounted is also called as a baffle body B. Acoustic filters 8*a* and 8*b* (see FIG. 1) may be stuck on the baffle body B such that the acoustic filter 8*a* covers the penetration hole 3*g* of the yoke 3*c* and the acoustic filter 8*b* covers the vent holes 7*c* of the baffle 7, while allowing ventilation through the acoustic filters 8*a* and 8*b*. The acoustic filters 8*a* and 8*b* are formed by a nonwoven fabric or the like, and work as acoustic resistance. For the acoustic filters 8*a* and 8*b*, a material and a thickness to improve output sounds are selected and set in a work of controlling tone quality in designing of the earphone 51.

Next, the baffle body B is fixed to the rear housing 5. Concretely, as shown in FIG. 1, the rear housing 5 includes step portion 5*a* in an annular shape at an inner front end portion thereof, with which a peripheral portion of the baffle 7 of the baffle body B engages. The baffle 7 is engaged with the step portion 5*a* from the front side thereof and fixed by adhesion or deposition. Then, a rear end portion of the front housing 4 is faced to a front end portion of the rear housing 5 to be combined into a single unit by adhesion or deposition. The earphone 51 is assembled including these steps.

The inside of the housing 6 is substantially divided into a front space Vf, which is an air chamber in front of the baffle 7, and a rear space Vg, which is an air chamber behind the baffle 7, by the baffle body B configured to include the baffle 7 and the speaker unit 3. More particularly, the front space Vf is a space where a diaphragm front space Vfa communicates with a joint space Vfb. The diaphragm front space Vfa is in front of the diaphragm 3*a* and is substantially a space on a sound emission surface side of the speaker unit 3. The joint space Vfb around the speaker unit 3 and between the speaker unit 3 and the baffle 7.

That is, the front space Vf includes spaces Vf1 to Vf4, which communicates with each other. The diaphragm front space Vfa includes the space Vf1 and the space Vf2. The joint space Vfb includes the space Vf3 and the space Vf4.

First, the front space Vf will be described. The space Vf1 in the diaphragm front space Vfa is an inner space of the sound tube portion 4*a*. The space Vf2 is a space communicating with the space Vf1 at a rear side of the space Vf1 and mainly surrounded by an inner surface 4*b*, at which a diameter of the front housing 4 expands or shrinks, and the diaphragm 3*a* of the speaker unit 3.

The space Vf3 in the joint space Vfb communicates with the space Vf2 at a rear side of a periphery of the space Vf2. The space Vf3 is a space in a tubular shape surrounded by an inner surface 4*c* at a largest diameter portion of the front housing 4 and a side surface 3*j* of the speaker unit 3. The space Vf3 may not need to have a constant width in a diameter direction in a circumferential direction. Moreover, the space Vf3 is not limited to one defined on the entire circumference and may be defined on a part in the circumferential direction between the inner surface 4*c* and the side surface 3*j*. That is, the inner surface 4*c* of the front housing 4 and the side surface 3*j* of the speaker unit 3 may be partially in contact. The space Vf4 is a space in a flat annular shape (flat washer shape), which communicates with the space Vf3 at a rear side of the space Vf3 and is surrounded by a rear surface 3*h*1 of the speaker unit 3 and the baffle 7. The rear surface 3*h*1 is on the outside of the pedestal portion 7*h* of the baffle 7 in the diameter direction.

The rear space Vg includes the space Va just behind the diaphragm 3*a* of the speaker unit 3, the space Vc within the penetration hole 3*g*, and a space Vd surrounded by the rear housing 5, the baffle 7 and the speaker unit 3.

The front space Vf communicates with the rear space Vg through spaces Ve, which are the inner spaces of the vent holes 7*c* of the baffle 7 (see arrow ARa in FIG. 1).

In this way, the earphone 51 includes the baffle 7 within the housing 6, which supports the speaker unit 3 to divide the inner space of the housing 6 into the front space and the rear space. The baffle 7 includes the vent holes 7*c* through which the divided front space communicates with the divided rear space. The speaker unit 3 has the rear surface 3*h* supported by the top surface 7*b*1 of the pedestal portion 7*b* to be set apart from the surface of the baffle 7 to define the space Vf4. This enables the space Vf3 around the speaker unit 3 to communicate with the vent holes 7*c*. That is, the pedestal portion 7*b* protruding in the front direction is formed on the baffle 7, and the top surface 7*b*1 of the pedestal portion 7*b* contacts with and supports the rear surface 3*h* of the speaker unit 3.

This enables the space Vf4, which communicates with the vent holes 7*c*, to be defined between the rear surface 3*h* of the speaker unit 3 and the baffle 7. Moreover, this enables a position of each of the vent holes of the baffle 7 in the diameter direction to be set such that at least a part of the position comes into a position within a maximum diameter of the speaker unit 3 (within a range of cast shadow on the baffle 7). For these reasons, is possible to make an external shape of the speaker unit 3 large in diameter to be just inside the inner surface 4*c* of the front housing 4, which is the inner surface of the housing 6.

Moreover, for the joint space Vfb around and behind the speaker unit 3, it is only required to have a function to enable the diaphragm front space Vfa to communicate with the rear space Vg, and a cross section of a flow passage of the joint space Vfb may be small. It is thus possible to make the outer diameter Db of the speaker unit 3 closer to the inside diameter Da of the inner surface 4*c* of the front housing 4 as much as possible. That is, it is possible to use the speaker unit 3 having a maximum diameter, which defines a space between the housing 6 and the speaker unit 3 in the diameter direction. This enables the earphone 51 to be formed with a communicating passage, through which the front space communicates with the rear space, without miniaturizing the speaker unit 3 in diameter, thereby providing good tone quality.

Figure 3:
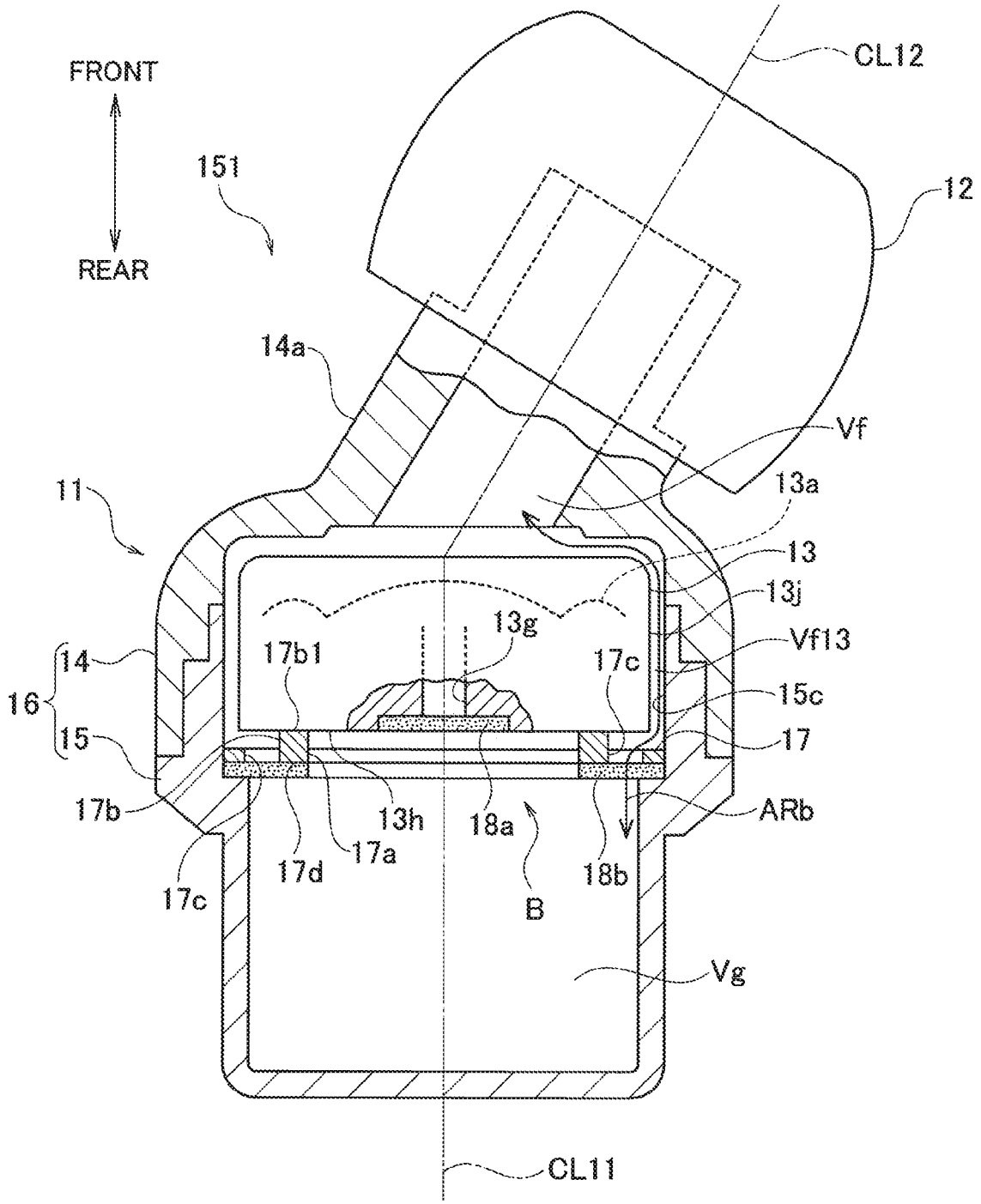
FIG. 3 is a vertical sectional view of an earphone that is a modification of the earphone according to the first exemplary embodiment.

FIG. 3 is a vertical sectional view of an earphone 151, which is a modification of the earphone 51, and corresponds to FIG. 1 for the most part. The earphone 151 is an example that has an almost same configuration as the earphone 51 and whose external appearance is mainly different. For example, a sound tube portion 14*a* is formed to protrude obliquely to the axial line CL11 of a body portion 11.

The body portion 11 of the earphone 151 includes a housing 16, which receives the speaker unit 13 therein. A front housing 14 and a rear housing 15 combined in the front-rear directions make up the housing 16. The front housing 14 includes the sound tube portion 14*a* in a tubular shape. The sound tube portion 14*a* is formed to protrude diagonally forward along an axial line CL12, which is oblique to the axial line CL11 of the front housing 14. An ear piece 12 is removably mounted on the sound tube portion 14*a*.

A baffle 17 in a flat ring shape having a first penetration hole 17*a* in the center is mounted within the rear housing 15 in a position extending in a direction orthogonal to the axial line CL11. The baffle 17 includes a pedestal portion 17*b*, which protrudes forward, on a peripheral portion or the vicinity of the first penetration hole 17*a*. A rear surface 13*h* of the speaker unit 13 is fixed on a top surface 17*b*1 of the pedestal portion 17*b*. The baffle body B here is made up of the speaker unit 13 and the baffle 17 on which the speaker unit 13 is mounted.

Vent holes 17*c* penetrating in the front-rear directions are formed on a portion on the outside of the pedestal portion 17*b* in the diameter direction of the baffle 17 of the baffle body B. The vent holes 17*c* are, for example, an arc-shaped hole, or a circular hole, and formed at respective positions set apart in the circumferential direction. An acoustic filter 18*b* in an annular shape is mounted on a rear surface 17*d* of the baffle 17. The acoustic filter 18*b* covers the vent holes 17*c* to allow ventilation. Moreover, the speaker unit 13 has a penetration hole 13*g*, which communicates with the space Va just behind a diaphragm 13*a*. The penetration hole 13*g*, which communicates with the space Va just behind the diaphragm 13*a* of the speaker unit 13, opens at a position corresponding to the penetration hole 17*a* of the baffle 17. An acoustic filter 18*a* is mounted to cover the penetration hole 13*g* to allow ventilation.

The front housing 14 and the rear housing 15 are combined in a concavo-convex engagement where the rear housing 15 is inside. A space Vf13, which allows ventilation in the front-rear directions, is defined as the joint space Vfb on the entire circumference between an inner surface 15*c* of the rear housing 15 at a portion corresponding to the combination and a side surface 13*j* of the speaker unit 13.

Through the space Vf13 and the vent holes 17*c* of the baffle 7, the front space Vf in an air chamber in front of the diaphragm 13*a* communicates with the rear space Vg in an air chamber behind the baffle 17 (see arrow ARb in FIG. 3). The space Vf13 is not limited to have a constant width in the diameter direction in the circumferential direction. Moreover, the space Vf13 is not limited to one defined on the entire circumference and may be defined on a part of the circumference between the inner surface 15*c* and the side surface 13*j*. That is, the inner surface 15*c* may partly contact with the side surface 13*j* of the speaker unit 3.

With the above-described configuration, the earphone 151 has the same effect as the earphone 51. That is, it is possible to use the speaker unit 13 having a maximum diameter, which defines a space between the housing 16 and the speaker unit 13 in the diameter direction. This enables the earphone 151 to be formed with a communicating passage, through which the front space communicates with the rear spaces, without miniaturizing the speaker unit 3 in diameter, thereby providing good tone quality.

Supposing the space Vf4 as a first space, the space Vd as a second space, the diaphragm front space Vfa as a third space, and the space Vf3 as a fourth space, the configuration of the earphone 51 will be described as follows. That is, the earphone 51 includes the speaker unit 3, the housing 6 receiving the speaker unit 3 therein, and the baffle 7 arranged within the housing 6 to support an opposite surface (rear surface 3*h*) opposite to the sound emission surface 3*k* of the speaker unit 3 to define the first space between the rear surface 3*h* and the baffle 7. Moreover, the baffle 7 includes the vent holes 7*c* through which the first space communicates with the second space opposite to the first space. Furthermore, the earphone 51 has the fourth space, through which the first space communicates with the third space on the side of the sound emission surface 3*k* of the speaker unit 3, between the side surface 3*j* of the speaker unit 3 and the inner surface 4*c* of the housing 6.

Second Embodiment

An earphone 52 according to a second exemplary embodiment is an example using a baffle 27 to support the side surface 3*j* of the speaker unit 3, instead of using the baffle 7 to support the rear surface 3*h* of the speaker unit 3 in the earphone 51. Members of the earphone 52, which are different from those of the earphone 51, include the front housing 4, the rear housing 5 and the baffle 27.

Figure 4:
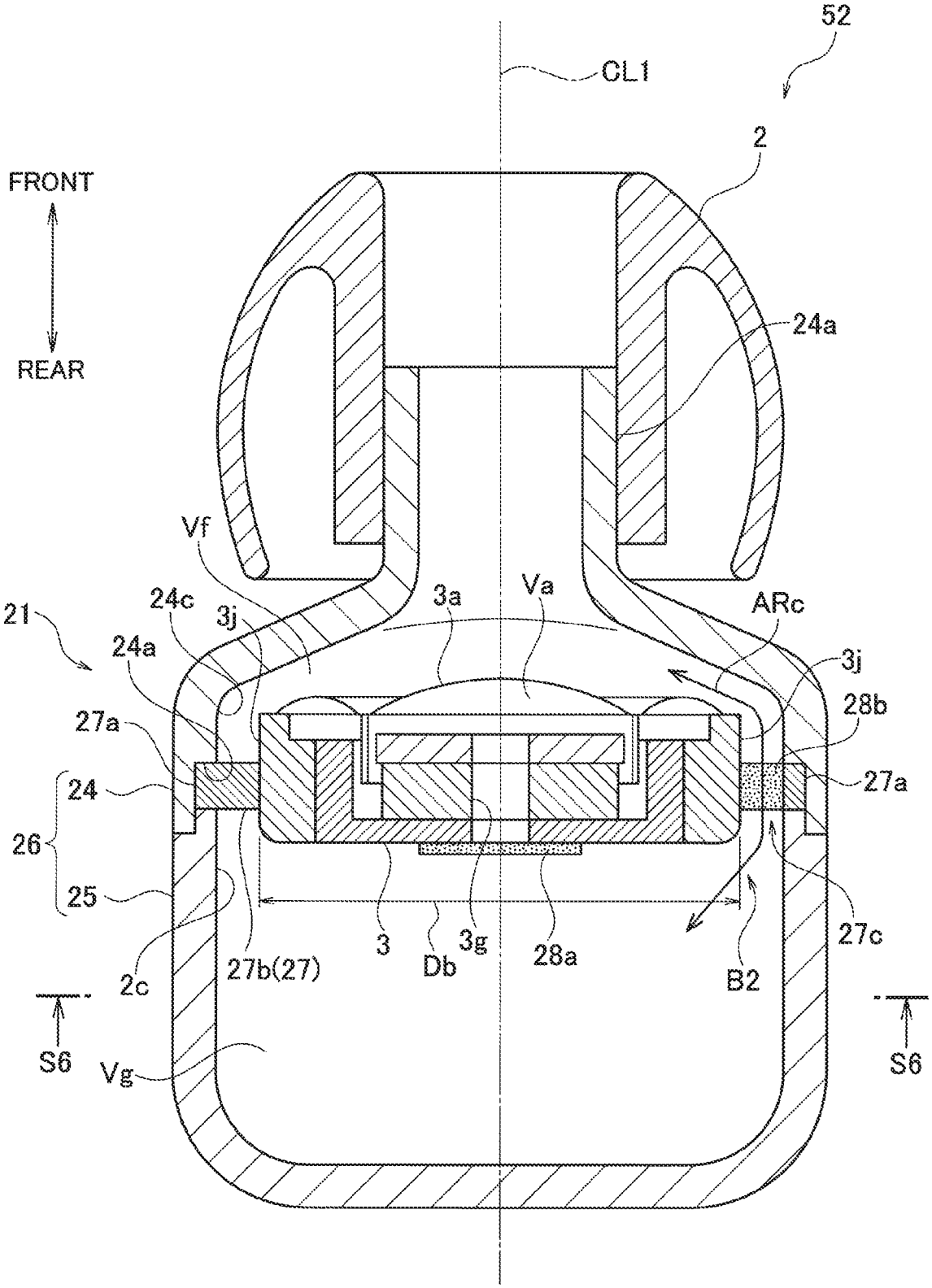
FIG. 4 is a vertical sectional view of an earphone according to a second exemplary embodiment.
Figure 5:
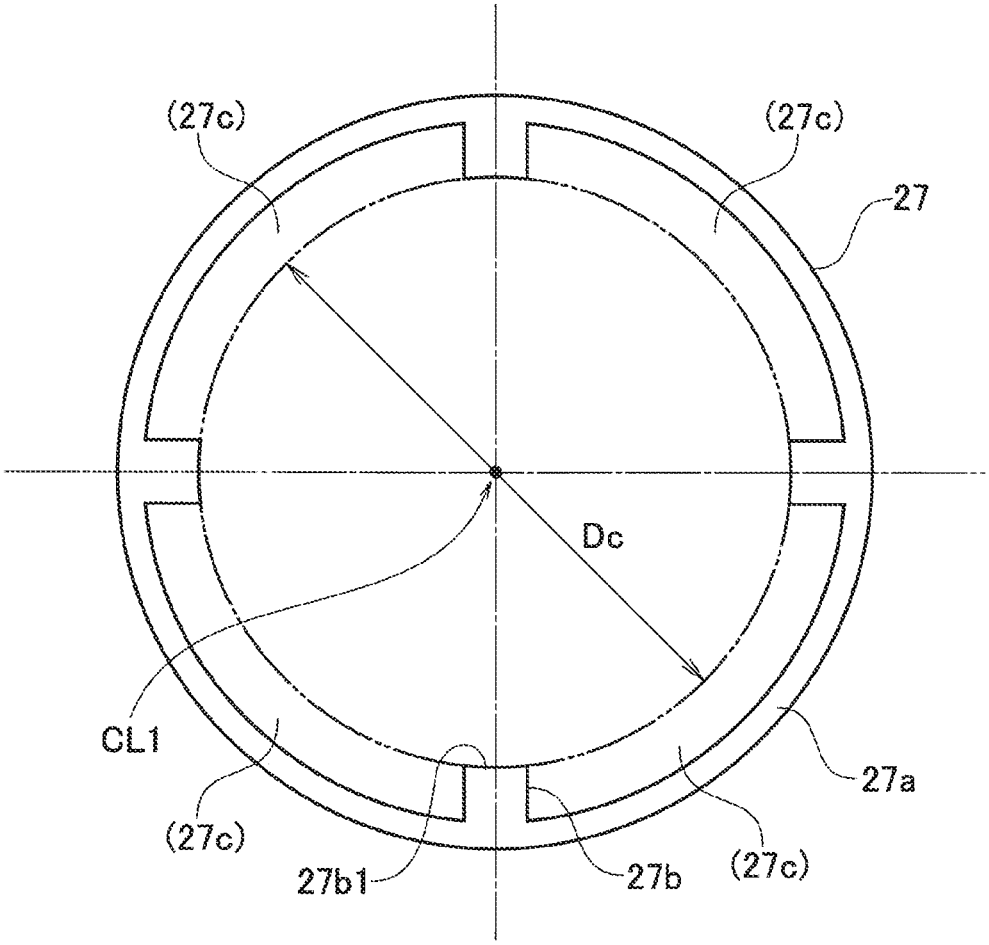
FIG. 5 is a plane view of a baffle of the earphone according to the second exemplary embodiment.
Figure 6:
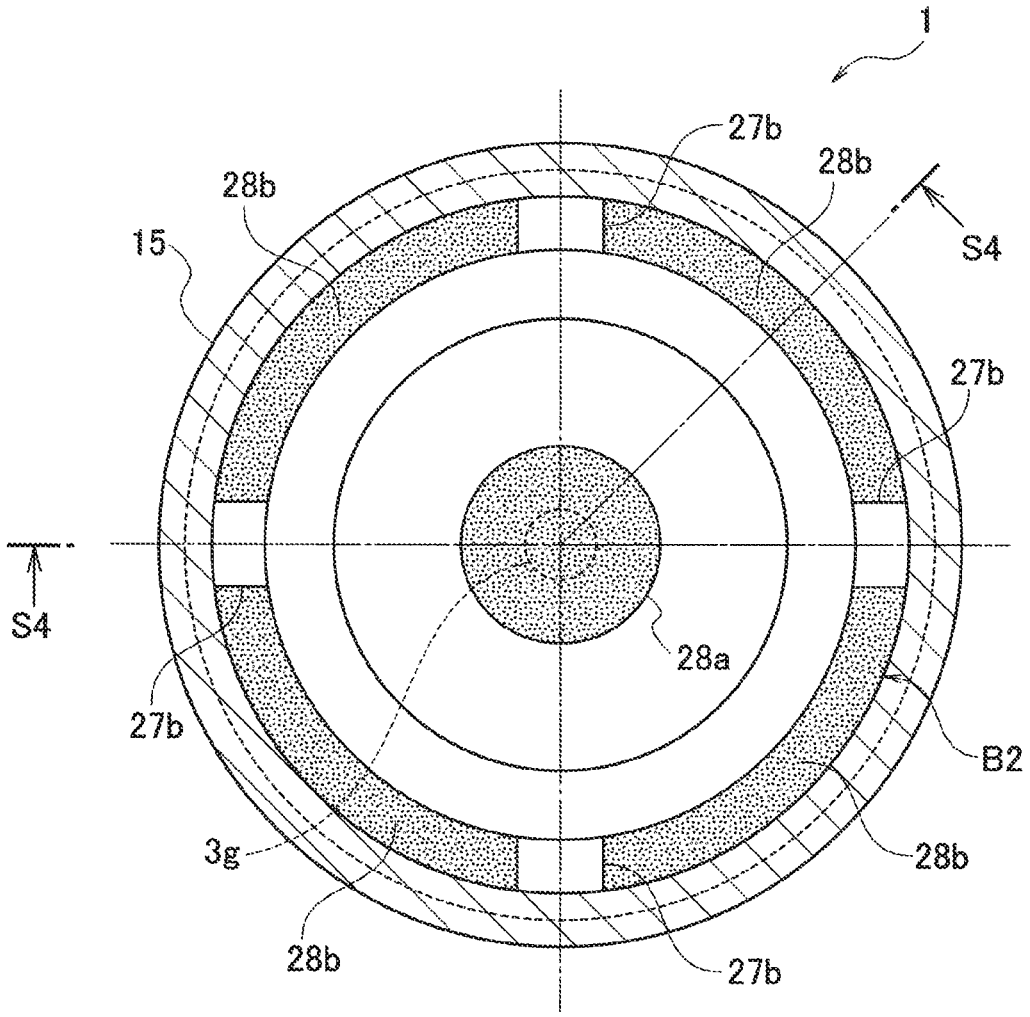
FIG. 6 is a cross-sectional view taken along a line S6-S6 in FIG. 4.

The earphone 52 will be described below with reference to FIGS. 4 to 6. FIG. 4 is a vertical sectional view of the earphone 52. FIG. 5 is a plane view of the baffle 27. FIG. 6 is a cross-sectional view taken along a line S6-S6 in FIG. 4. It noted that FIG. 4 is a cross-sectional view taken along a line S4-S4 in FIG. 6. In the following, the same reference signs are given to elements common to those of the earphone 51, and different points from the earphone 51 will be mainly described.

As shown in FIG. 4, the earphone 52 includes a body portion 21. The body portion 21 is configured to include a housing 26 having a front housing 24 and a rear housing 25, and the baffle 27 mounted within the housing 26 to support the speaker unit 3 to divide an inner space of the housing 26 into a front space and the rear space.

FIG. 5 is the plane view of the baffle 27 as a single item. As shown in FIGS. 4 and 5, the baffle 27 includes a base portion 27*a* in a circular shape around the axial line CL1, and supporting arm portions 27*b* protruding from an internal circumference of the base portion 27*a* toward the center of the baffle 27. The length of the protrusion of each of the supporting arm portions 27*b* is set such that a tip surface 27*b*1 thereof is to be an arc of a circle having a diameter Dc.

The diameter Dc is set to be slightly smaller than the outer diameter Db of the speaker unit 3. This enables the baffle 27 to support the side surface 3*j* of the speaker unit 3 in slightly tight fitting by the supporting arm portions 27*b* arranged apart in the circumferential direction and to be combined with the speaker unit 3 into a single unit. In manufacturing process of the earphone 52, the speaker unit 3 is fitted to the supporting arm portions 27*b* and fixed by a glue. The speaker unit 3 and the baffle 27 firmly supporting the speaker unit 3 make up a baffle body B2 (FIG. 4). In an example shown in FIG. 5, the supporting arm portions 27*b* are formed at four places at an interval of an angle of 90°. Space portions 27*c* (FIG. 5), each of which is in a circular arc shape, are formed on the baffle body B2 between adjacent supporting arm portions 27*b*, respectively.

In the manufacturing process of the earphone 52, the baffle body B2, which is previously formed, is first fixed to the front housing 24. Concretely, as shown in FIG. 4, a step portion 24*a* in an annular shape is formed on the front housing 24 at an inner rear end portion thereof, with which a peripheral portion of the baffle 27 engages. The base portion 27*a* of the baffle 27 is engaged with the step portion 24*a* from the rear thereof and fixed by adhesion or weld. Moreover, a front end portion of the rear housing 25 is faced to the rear end portion of the front housing 24 in a concavo-convex engagement to be combined into a single unit by adhesion or weld while sandwiching the base portion 27*a* of the baffle 27 therebetween.

This defines the previously-described space portions 27*c* in the circular arc shape, which are surrounded by the speaker unit 3, and the supporting arm portions 27*b* and the base portion 27*a* of the baffle 27. The space portions function as vent holes to enable the front space Vf in an air chamber in front of the baffle 27 to communicate with the rear space Vg in an air chamber behind the baffle 27. That is, the front space Vf in the air chamber in front of the baffle 27 communicates with the rear space Vg in the air chamber behind the baffle 27 through the space portions 27*c* (see arrow ARc in FIG. 4).

As shown in FIG. 6, acoustic filters 28*b* (halftone) formed in slightly tight fitting to the space portions 27*c* in shape and size may be fitted to the space portions 27*c* to allow ventilation. The space Va just behind the diaphragm 3*a* of the speaker unit 3 communicates with the rear space Vg through the penetration hole 3*g*. An acoustic filter 28*a* may be mounted to cover the opening of the penetration hole 3*g* to allow ventilation.

As described above, the earphone 52 includes the baffle 27, which supports the speaker unit 3 to divide the inner space of the housing 26 into the front space and the rear space. The baffle 27 supports the speaker unit 3 by the supporting arm portions 27*b* at the side surface 3*j* thereof. Moreover, the baffle body B2 includes the space portions 27*c*, which function as vent holes through which the divided front space communicates with the divided rear space. The front space Vf within the housing 26 communicates with the rear space Vg within the housing 26 through the space portions 27*c* around the speaker unit 3.

It is possible to form the space portions 27*c*, which allow ventilation in the front-rear directions, smaller in the diameter direction thereof. For example, each of the space portions 27*c* may be formed in an arc shape having a length in the circumferential direction thereof longer than a length in the diameter direction thereof. It is thus possible to make the external shape of the speaker unit 3 larger in diameter to be just inside the inner surfaces 24*c*, 25*c* of the housing 26. This enables the earphone 52 to be formed with a communicating passage through which the front space communicates with the rear space, without miniaturizing the speaker unit 3 in diameter, thereby providing good tone quality.

The above-detailed exemplary embodiments are not intended to be limited to the above-described configurations and may be modified within a s not deviating from the gist of the present invention.

The method of defining the space Vf4 by setting the baffle 7 and the speaker unit 3 apart in the front-rear directions in the earphones 51 and 151 is not limited to providing the pedestal portion 7*b* in a protruding manner on the baffle 7. It is possible to provide a protruding portion with a height Ha on the rear surface 3*h* of the speaker unit 3 and to make the protruding portion contact with and fixed to the baffle 7. It is naturally possible to provide the protruding portion on both the baffle 7 and the speaker unit 3 and to make the protruding portions contact each other for fixation. The height Ha may be any value that enables a space (gap) allowing the ventilation to be defined between the baffle 7 and the speaker unit 3.

The earphones 51, 151, and 52 are explained as a canal type earphone, however not limited to the canal type earphone. The earphones 51, 151, and 52 may be a typical inner ear type earphone to mount the body portion 1 into a concha and not to have the ear piece 2 or 12, the sound tube portion 4*a* or 14*a* and the like, inserted into an external auditory canal as the canal type earphone.

The housings 6, 16 and 26, and the baffles 7, 17 and 27 are not limited to ones made of a resin and may be made of other material such as a metal or a ceramic.

Each of the vent holes 7*c*, and 17*c* is not limited to a penetration hole formed around one axial line. For example, each of the vent holes 7*c*, and 17*c* may be a hole allowing ventilation, which is made by concave portions that are bored from both surfaces and communicating with each other.

According to the present invention, a communicating passage, through which the front space of the speaker communicates with the rear space of the speaker, is formed without miniaturizing the speaker unit in diameter, thereby providing good tone quality.

What is claimed is:

1. An earphone comprising:

a speaker unit;

a housing that receives the speaker unit therein; and a baffle that is arranged within the housing and supports an opposite surface of the speaker unit, which is opposite to a sound emission surface of the speaker unit, to define a first space between the opposite surface and the baffle, wherein the baffle has a configuration that establishes a second space between the baffle and an inner surface of the housing which faces the opposite surface of the speaker unit, and includes a vent hole through which the first space communicates with the second space, and a fourth space through which the first space communicates with a third space on a side of the sound emission surface of the speaker unit is defined between a side surface of the speaker unit and an inner surface of the housing.

2. The earphone according to claim 1, wherein the first space is defined by supporting the speaker unit by a protruding portion formed in a protruding manner on the baffle or on the speaker unit.

3. The earphone according to claim 1, wherein at least a part of the vent hole is formed within a range of a cast shadow of the speaker unit on the baffle.

4. An earphone comprising:

a speaker unit;

a housing that receives the speaker unit therein; and a baffle that is arranged within the housing and includes a base portion having a diameter larger than that of the speaker unit, and a plurality of supporting arm portions protruding from the base portion toward inside in a diameter direction of the baffle and supporting the side surface of the speaker unit at positions set apart in a circumferential direction of the baffle, wherein a space on one side of the baffle in the housing communicates with a space on another side of the baffle in the housing through vent holes, each of the vent holes formed between the speaker unit and adjacent supporting arm portions of the plurality of supporting arm portions.

5. The earphone according to claim 4, wherein each of the vent holes is in an arc shape having a length in the circumference direction longer than a length in the diameter direction.

* * * * *